US009366979B2

(12) United States Patent
Li et al.

(10) Patent No.: US 9,366,979 B2
(45) Date of Patent: Jun. 14, 2016

(54) ROBUST PHASE INVERSION EMULSIFICATION PROCESS FOR POLYESTER LATEX PRODUCTION

(71) Applicant: XEROX CORPORATION, Norwalk, CT (US)

(72) Inventors: Shigeng Li, Webster, NY (US); Shigang Qiu, Toronto (CA); Peter Van Nguyen, Webster, NY (US); Amy Avolia Grillo, Rochester, NY (US); Chieh-Min Cheng, Rochester, NY (US)

(73) Assignee: XEROX CORPORATION, Norwalk, CT (US)

( * ) Notice: Subject to any disclaimer, the term of this patent is extended or adjusted under 35 U.S.C. 154(b) by 54 days.

(21) Appl. No.: 14/245,926

(22) Filed: Apr. 4, 2014

(65) Prior Publication Data

US 2015/0286156 A1 Oct. 8, 2015

(51) Int. Cl.
*G03G 9/087* (2006.01)
*G03G 9/08* (2006.01)

(52) U.S. Cl.
CPC ..... *G03G 9/0804* (2013.01); *G03G 9/08795* (2013.01); *G03G 9/08797* (2013.01)

(58) Field of Classification Search
CPC G03G 9/0802; G03G 9/0819; G03G 9/08755
See application file for complete search history.

(56) References Cited

U.S. PATENT DOCUMENTS 7,851,549 B2 12/2010 Sacripante et al.
2009/0155712 A1* 6/2009 Sacripante ..... C08J 3/07 430/137.22
2011/0200930 A1 8/2011 Qiu et al.

* cited by examiner

*Primary Examiner* — Peter Vajda
(74) *Attorney, Agent, or Firm* — Shimokaji IP

(57) ABSTRACT

The disclosure provides robust phase inversion emulsification (PIE) processes, which produces polyester latex particles having particle size distributions with high centering capability indexes (Cpk), for the preparation of toners of good quality.

13 Claims, 5 Drawing Sheets

ROBUST PHASE INVERSION EMULSIFICATION PROCESS FOR POLYESTER LATEX PRODUCTION

TECHNICAL FIELD

The disclosure is generally directed to phase inversion emulsification (PIE) processes for preparing latex particles, which can be used as the major component of toner particles in toner compositions. More specifically, the disclosure is directed to robust PIE processes with high centering capability indexes (Cpk) and which produce stable polyester latex particles having desired particle size distributions.

BACKGROUND

PIE processes may use a polyester polymer to prepare latex particles which can be modified for use as toner particles in a toner. These processes convert a dispersed polymer in a hydrophobic organic solvent from a water-in-oil emulsion to an oil-in-water emulsion, whereby the polymer is dispersed as an emulsion of latex particles. Subsequent addition of a colorant or a pigment, followed by addition of an aggregating agent or complexing agent, forms aggregated latex particles which may then be heated to allow coalescence/fusing, thereby achieving spherical, aggregated, fused toner particles. Solvent based PIE processes for producing polyester latexes suitable for use in a toner have been described in U.S. Pat. No. 8,192,913, the disclosure of which is hereby incorporated in its entirety by reference.

Most commercial producers of toner using PIE processes add a fixed amount of reagents and solvents to produce their latexes. However, the acid value for most polyester polymers varies lot-by-lot, leading to variability in latex particle sizes and wide particle size distribution from batch to batch.

FIG. 1 illustrates the variability of the resulting latex particle sizes and wide distribution provided by using a fixed amount of reagents and solvents in a conventional PIE process. As shown in this figure, the mean particle size of the latex particles produced is about 199 nm, but the particle size distribution exceeds a desired lower specification limit (175 nm) and a desired upper specification limit (225 nm) resulting in a process with a centering capability index (Cpk) of less than about 0.6, which is not a robust process, i.e., the ability of a process to produce an output centered between upper and lower specification limits. A Cpk of about 1.3 or higher can be considered a robust process.

There remains a need for improved PIE processes to accommodate the variation in acid values found in different lots of polyester polymers, in order to produce polyester latexes having a stable particle size and distribution for improved toner quality.

SUMMARY

The following detailed description is of the best currently contemplated mode of carrying out exemplary embodiments herein. The description is not to be taken in a limiting sense, but is made merely for the purpose of illustrating the general principles of the exemplary embodiments herein, since the scope of the disclosure is best defined by the appended claims.

Various inventive features are described below that can each be used independently of one another or in combination with other features.

Broadly, embodiments of the disclosure herein generally provide a toner composition comprising latex particles with a particle size distribution of from about 175 nm to about 225 nm, and with a distribution width of from about 80 nm to about 120 nm.

In an embodiment, a phase inversion emulsification process for preparing latex particles includes contacting a polymer with a solvent and a neutralizing agent, wherein the particles have a lower specification limit of from about 150 nm to about 200 nm, and wherein the particles have an upper specification limit of from about 200 nm to about 250 nm.

In another embodiment, a phase inversion emulsification process for preparing latex particles includes contacting a polymer with a solvent and a neutralizing agent, wherein the neutralizing agent is present at a neutralization ratio of from about 50% to about 150%, and wherein the process has a Cpk of from about 0.8 to about 1.3.

BRIEF DESCRIPTION OF THE FIGURES

Various embodiments of the present disclosure can be described herein below with reference to the following figures wherein.

DETAILED DESCRIPTION

Figure 1:
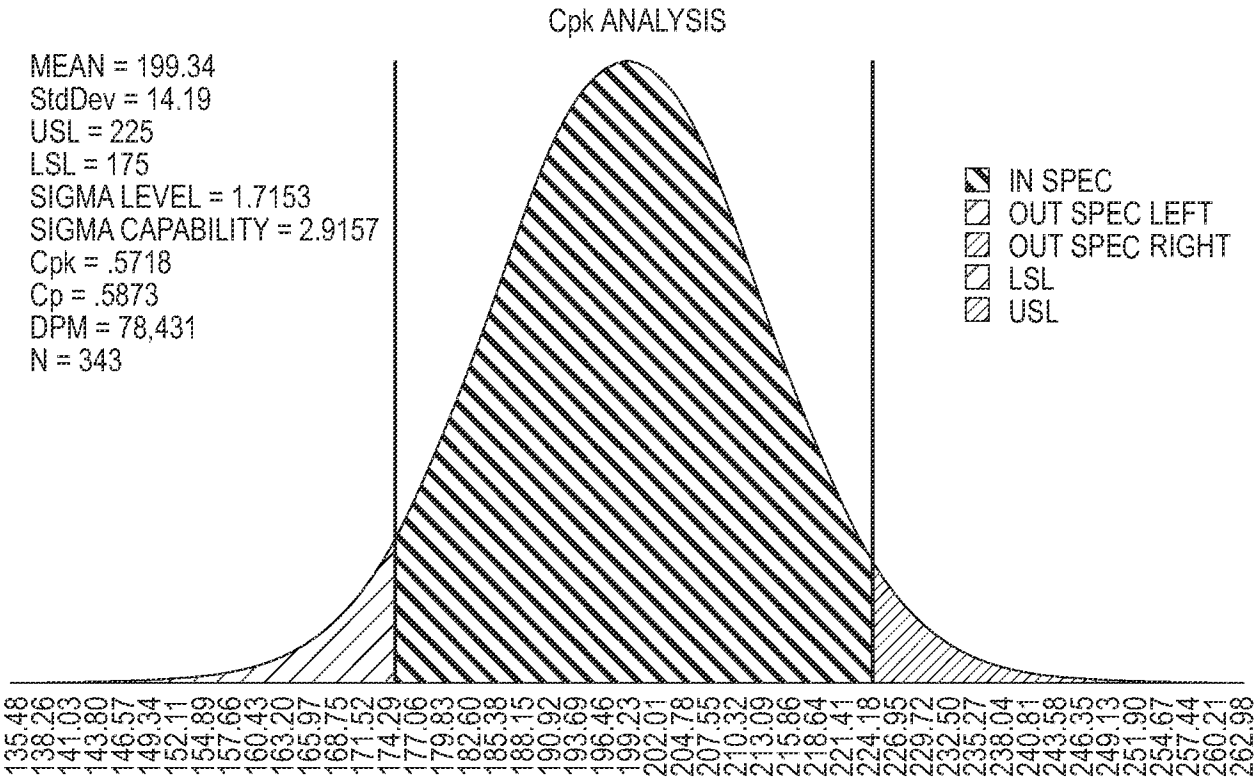
FIG. 1 illustrates a conventional latex particle size distribution for a latex made with two solvents using a fixed amount of reagents.

In the present disclosure, "capability index" or "Cp" refers to a statistical measure of process capability: the ability of a process to produce an output that fits within upper and lower specification limits.

In the present disclosure, "centering capability index" or "Cpk" also refers to a statistical measure of process capability: the ability of a process to produce an output centered between upper and lower specification limits. A Cpk measures how much natural variation a process experiences relative to its upper and lower specification limits, which allows different processes to be compared with respect to how well the processes are controlled.

In the present disclosure, "particle size" refers to the length of a particle.

In the present disclosure, a "particle size distribution" may be characterized graphically using x and y coordinates, wherein the x coordinate provides a measurement of particle size, typically in units of nanometers (nm); and the y coordinate provides a measurement of the number of particles present in the distribution. In the present disclosure, a particle size distribution may be characterized using terms "D10," D50," and "D95," wherein D10 refers to a particle size distribution wherein 10% of the particles lie below this value; D50 refers to a particle size distribution wherein 50% of the particles lie below this value; and D95 refers to a particle size distribution wherein 95% of the particles lie below this value.

In the present disclosure, "width" or a "distribution width" refers to +/−one standard deviation unit of a particle size distribution.

In the present disclosure, "upper specification limit" refers to the upper limit of particle size which meets the requirements of a desired aggregation/coalescence (A/C) process.

In the present disclosure, "lower specification limit" refers to the lower limit of particle size which meets the requirements of a desired aggregation/coalescence (A/C) process.

In the present disclosure, "solvent ratio" refers to the amount of a reagent to the amount of solvent, i.e., it is a measure of the concentration of a reagent in a solution or mixture. Solvent ratios may also be calculated for the components present in a solution or a mixture. For example, a solvent ratio can refer to the amount of a polyester polymer to the amount of solvent present in a solution or mixture. As described in U.S. Pat. No. 7,851,549, the disclosure of which is hereby incorporated by reference in its entirety, solvent ratio is a factor that determines latex particle size made by a PIE process.

In the present disclosure, "neutralization ratio" refers to the amount of neutralizing agent or base utilized to neutralize a polymer's acidic groups. For example, a neutralization ratio of 1.0 or 100% implies that every acidic moiety in the polymer is neutralized by a basic moiety. A neutralization ratio of 110% implies that 10% additional base was utilized to neutralize 100% of the polymer based on the acid value of the polymer. A neutralization ratio of 90% implies that 10% less base was utilized to neutralize 100% of the polymer based on the acid value of the polymer.

The present disclosure provides improved compositions and methods for forming polyester latex particles, which may be modified to form toner particles for use in a toner. The improved compositions and methods for their preparation include use of a new PIE process that accommodates the variation in acid values found in different lots of polyester polymers. Using one or more solvents, the PIE process generates stable polyester latex particles at certain neutralization ratios, with minimal variability in particle sizes and having a particle size distribution with a Cpk of about 1.0 or more.

In embodiments, a method for preparing latex particles includes contacting at least one polyester polymer with a solvent(s), along with a first amount of a neutralizing agent, and a first amount of water to form a dispersed polymer mixture. The mixture may then be contacted with a second amount of a second neutralizing agent and a second amount of water to form an emulsion of latex particles. The first and second neutralizing agents may be the same or different. The latex particles may be recovered and further modified with an optional surfactant, an optional colorant, an optional wax, and/or an optional second polyester polymer to form toner particles for a toner.

Polymer(s)

In embodiments, any polymer(s) known in the art may be utilized in the disclosed embodiments herein to form a latex emulsion and latex particles suitable for forming toner particles for use in a toner. For example, the polymer(s) may be an amorphous polyester polymer, a crystalline polyester polymer, and/or various combinations thereof. Suitable amorphous polyester polymers include but are not limited to ethoxylated and propoxylated bis phenol A derived polyester polymers. Other suitable polymers include saturated or unsaturated polyester polymers; and/or high molecular weight or low molecular weight polyester polymers. Other useful polyester polymers include those described in U.S. Pat. Nos. 8,192,913; 6,830,860; 6,756,176; 6,593,049; and 6,063,827; and U.S. Patent Application Publication No. 2006/0222991, the disclosures of each of which are hereby incorporated by reference in their entirety.

In embodiments, a suitable polymer may be based on any combination of propoxylated and/or ethoxylated bisphenol A, terephthalic acid, fumaric acid, and dodecenyl succinic anhydride. For example, the polyester polymer may have formula I:

(I)

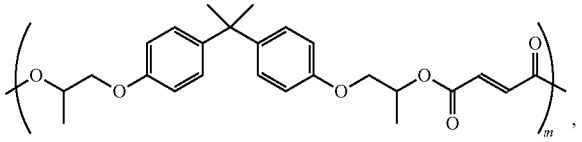

wherein m may be from about 5 to about 1000.

In embodiments, propoxylated bisphenol A derived polyester polymers available from Kao Corporation, Japan, may be utilized. These polymers include acid groups and may be of low molecular weight or high molecular weight. Their latex particles are commonly incorporated into ultra-low-melt (ULM) toners (78% in toner composition).

In embodiments, a high molecular weight polyester polymer may have a weight average molecular weight of from about 40,000 g/mol to about 150,000 g/mol, or from about 50,000 g/mol to about 140,000 g/mol, or from about 60,000 g/mol to about 125,000 g/mol of polymer. A low molecular weight polyester polymer may have a weight average molecular weight of from about 10,000 g/mol to about 40,000 g/mol, or from about 15,000 g/mol to about 30,000 g/mol, or from about 20,000 g/mol to about 25,000 g/mol of polymer.

In embodiments, the polymer utilized may be in an amount from about 50 weight % to about 100 weight %, or from about 60 weight % to about 90 weight %, or from about 70 weight % to about 80 weight % of the first polymer mixture.

In embodiments, the polymer utilized may possess acid groups, which may be present at the internal or terminal regions of the polymer. Acid groups which may be present include carboxylic acid groups and the like. The number of carboxylic acid groups present may be controlled by adjusting the materials and reaction conditions used to form the polymer.

Solvent(s)

In embodiments, one or more suitable solvents, such as organic solvents, may be used to partially or wholly dissolve the polymer(s). For example, alcohols, esters, ethers, ketones, amines, and combinations thereof may be conveniently used to partially or wholly dissolve the polyester polymer(s).

In embodiments, suitable organic solvents utilized include, for example, alcohols such as methanol, ethanol, propanol, isopropanol, n-butanol, sec-butanol, and the like; esters such as methyl acetate, ethyl acetate, isoproly acetate, and the like; ketones such as acetone, methyl ethyl ketone, diethyl ketone, and the like, and combinations thereof.

In embodiments, the organic solvent(s) utilized may be methyl ethyl ketone or a combination of methyl ethyl ketone and isopropyl alcohol, also known as isopropanol.

In embodiments, suitable organic solvents may be soluble, partially soluble, or insoluble in water. Such organic solvents may have a boiling point from about 50° C. to about 200° C., or from about 75° C. to about 175° C., or from about 100° C. to about 150° C.

In embodiments, the amount of organic solvent(s) in the embodiments herein may be, for example, from about 20 weight % to about 100 weight %, or from about 30 weight % to about 90 weight %, or from about 40 weight % to about 80 weight % by weight of the polymer(s).

In embodiments, the organic solvent(s) may be methyl ethyl ketone. In embodiments, methyl ethyl ketone may be utilized, for example, from about 10 weight % to about 100 weight %, or from about 30 weight % to about 90 weight %, or from about 40 weight % to about 80 weight % by weight of the polymer(s).

In embodiments, the organic solvents may be a mixture of methyl ethyl ketone and isopropyl alcohol. In embodiments, methyl ethyl ketone may be utilized, for example, of from about 10 weight % to about 100 weight %, or from about 30 weight % to about 90 weight %, or from about 40 weight % to about 80 weight % by weight of the polymer(s). Isopropyl alcohol may be utilized, for example, of from about 20 weight % to about 100 weight %, or from about 30 weight % to about 90 weight %, or from about 40 weight % to about 80 weight % by weight of the polymer(s).

In embodiments, the solvent ratio of the amount of weight of polymer to the amount of weight of solvents herein may be of from about 10% to about 100%, or from about 20% to about 80%, or from about 30% to about 70%.

Water

In embodiments, an emulsion formed in accordance with the present disclosure may also include a quantity of water. In embodiments, the water may be de-ionized water (DIW), which may be utilized in amounts from about 10 weight % to about 200 weight %, or from about 20 weight % to about 150 weight %, or from about 50 weight % to about 100 weight % of the polymer.

In embodiments, the water may be present at temperatures which softens or melts the polymer, for example, temperatures of from about 30° C. to about 120° C., or from about 40° C. to about 100° C., or from about 50° C. to about 80° C.

Neutralizing Agent(s)

In embodiments, the polymer(s) utilized may be neutralized with a neutralizing agent(s) or a weak base(s), which reacts with the acid groups present on the polymer to partially or wholly neutralize the polymer. In embodiments, the neutralizing agent(s) may be used in any amount to neutralize acid groups present in the polymer. Any suitable neutralizing agent(s) may be used in accordance with the present disclosure.

In embodiments, suitable neutralizing agents include both inorganic base reagents and organic base reagents. Suitable neutralizing agents include but are not limited to ammonium hydroxide, potassium hydroxide, sodium hydroxide, sodium carbonate, sodium bicarbonate, lithium hydroxide, potassium carbonate, combinations thereof, and the like.

In embodiments, suitable neutralizing agents may also include monocyclic compounds and polycyclic basic compounds having at least one nitrogen atom, such as, for example, secondary amines, which include aziridines, azetidines, piperazines, piperidines, pyridines, bipyridines, terpyridines, dihydro-pyridines, morpholines, N-alkylmorpholines, 1,4-diazabicyclo[2.2.2]octanes, 1,8-diazabicycloundecanes, 1,8-diazabicycloundecenes, dimethylated pentylamines, trimethylated pentylamines, pyrimidines, pyrroles, pyrrolidines, pyrrolidinones, indoles, indolines, indanones, benzindazones, imidazoles, benzimidazoles, imidazolones, imidazolines, oxazoles, isoxazoles, oxazolines, oxadiazoles, thia-diazoles, carbazoles, quinolines, isoquinolines, naphthyridines, triazines, triazoles, tetrazoles, pyrazoles, pyrazolines, and combinations thereof. In embodiments, the monocyclic and polycyclic compounds may be unsubstituted or substituted at any carbon position on the ring.

In embodiments, the neutralizing agent may be utilized in the form of an aqueous and/or alcohol solution. In other embodiments, the neutralizing agent may be utilized in the form of a solid. Any of the neutralizing agents disclosed herein may be formulated into an aqueous and/or alcohol solution of known concentration by those of skill in the art.

In embodiments, the neutralizing agent or base utilized may be about a 10% aqueous ammonia solution, i.e., 10% $NH_3$ or 10% $NH_4OH$. The preparation of aqueous ammonia solutions are well known to those of skill in the art and/or such solutions are commercially available.

In embodiments, the addition of a neutralization agent may raise the pH of a solution or mixture that contains a polymer, for example, starting from about 5 to about 12 pH, or starting from about 6 to about 10 pH, or starting from about 7 to about 8 pH of the solution or mixture, thus enhancing emulsion formation.

In embodiments, a neutralization agent may be utilized in a first amount, along with one or more organic solvents and a first amount of water to form a dissolved, dispersed polymer mixture; and, subsequently, the same or a different neutralizing agent may be utilized in a second amount to form a second, dissolved dispersed polymer mixture. In embodiments, the molar ratio of the first amount of the neutralizing agent to the second amount of the neutralizing agent may be from about 30% to about 70%, or from about 40% to about 60%, or from about 45% to about 55%, or about 50%.

In embodiments, a neutralizing agent(s) may be added to a solution or mixture of a polyester polymer as a first neutralizing agent and a second neutralizing agent. The first and second neutralizing agents may be used as a solid or may be present in solution, for example, in an aqueous or alcohol solution, and may be used at a concentration, for example, from about 0.1 weight % to about 10 weight %, or from about 1 weight % to about 8 weight %, or from about 1 weight % to about 2 weight % of the polymer.

Neutralization Ratio

In embodiments herein, the neutralized polyester chains tend to migrate into the more hydrophilic water droplets while the un-neutralized parts aggregate together in the more hydrophobic organic solvents. The size and number of polyester molecules in the water and organic solvent(s) can influence the size and distribution of the final latex particles. Thus, the extent of neutralization of the polymer in embodiments herein can determine the final particle size distribution of the resulting latex particles.

In embodiments, a neutralization ratio of a polyester polymer may be calculated as the molar ratio of basic groups provided with the neutralizing agent to the acid groups present in the polymer multiplied by 100%:

neutralization ratio=[amount of neutralizing agent utilized/amount of neutralizing agent needed to neutralize the polymer's acidic groups]×100%.

Equation 1 illustrates, according to embodiments herein, the relationship between the amount of neutralizing agent or base, e.g. 10% $NH_3$ (10% ammonia), the neutralization ratio, the amount of polymer, and the acid value of the polymer.

amount of neutralizing agent=(neutralization ratio)(amount of polymer)(acid value)(mw neutralizing agent/mw KOH)(0.01) Equation 1:

wherein "mw" refers to molecular weight and (0.01) is an adjustment factor for units. For example, the ratio of the molecular weight of ammonia (17.031 g/mole) to the molecular weight of potassium hydroxide (56.106 g/mole) is 0.303.

In embodiments, a neutralization agent in combination with a polyester polymer possessing acid groups may be present at a neutralization ratio from about 50% to about 150%, or from about 75% to about 125%, or from about 90% to about 110%.

In Equation 1, the acid value of the polymer is an independent variable, in which the amount of neutralizing agent added may be adjusted to achieve a specific neutralization ratio for a desired particle size distribution.

In the present disclosure, "acid value" refers to the mass of potassium hydroxide (KOH) in milligrams (mg) that is required to neutralize one gram of a chemical substance, e.g., a polyester polymer, having one or more acid groups.

The acid value of the polymer may be determined by titration of the polymer solution with a known concentration or amount of a base, such as a KOH/methanol solution using phenolphthalein as the indicator. The acid value of the polymer may be calculated based on the equivalent amount of KOH/methanol required to neutralize all the acid groups on the polymer identified as the end point of the titration. Standard KOH/methanol solutions are readily prepared by those of skill in the art or are commercially available.

In embodiments, the polymer utilized may have an acid value from about 1 mg KOH/g of polymer to about 200 mg KOH/g of polymer, or from about 5 mg KOH/g of polymer to about 150 mg KOH/g of polymer, or from about 10 mg KOH/g of polymer to about 100 mg KOH/g of polymer. By keeping the amount of neutralizing agent or base used constant, an acid value for a polyester polymer for a particular neutralization ratio can be calculated via Equation 2 by rearranging Equation 1.

Acid value=(amount of neutralizing agent)/[(neutralization ratio)(amount of polymer)(mw neutralizing agent/mw KOH)(0.01)] Equation 2:

The range of acid values can be calculated for generating latex particles with a desired particle size distribution.

In embodiments, the particle size distribution may be from about 175 nm to about 225 nm, or from about 190 nm to about 210 nm, or from about 195 nm to about 205 nm.

In embodiments, the mean particle size distribution (D50) may be from about 175 nm to about 225 nm, or from about 190 nm to about 210 nm, or from about 195 nm to about 205 nm.

In embodiments, the mean particle size distribution (D95) may be from about 200 nm to about 400 nm, or from about 220 nm to about 320 nm, or from about 260 nm to about 310 nm.

In embodiments, the distribution width may be from about 80 nm to about 120 nm, or from about 90 nm to about 110 nm, or from about 95 nm to about 105 nm, or about 100 nm.

In embodiments, an upper specification limit may be from about 200 nm to about 250 nm, or from about 210 nm to about 240 nm, or from about 220 nm to about 230 nm, or about 225 nm.

In embodiments, a lower specification limit may be from about 150 nm to about 200 nm, or from about 160 nm to about 190 nm, or from about 170 nm to about 180 nm, or about 175 nm.

In embodiments, the Cpk may be from about 0.8 to about 1.3, or from about 0.9 to about 1.2, or from about 1.0 to about 1.1.

Toner Composition Preparation

Once the emulsion has been formed and the solvents are removed, the resulting latex particles may then be utilized to form toner particles for a toner by any method known to those of skill in the art. The polyester latex emulsion or latex particles may be modified through contact with one or more colorants or pigments, waxes, and/or other additives to form an ultra-low melt toner by a suitable process, for example, through an emulsion aggregation and coalescence process.

In embodiments, the optional additional ingredients of a toner composition including a colorant, wax, and/or other additives, may be added before, during or after the emulsification process of the present disclosure to produce latex particles. In further embodiments, the colorant may be added before the addition of a surfactant.

In embodiments, the processes and compositions of the present disclosure may optionally include adding one or more surfactants, before, during or after latex formation, to the polyester polymer. Suitable surfactants may be selected from ionic surfactants, including anionic and cationic surfactants, and nonionic surfactants. In embodiments, the surfactant may be added as a solid or as a solution with a concentration from about 0.01 weight % to about 95 weight %, or from about 0.1 weight % to about 20 weight %, or from about 1 weight % to about 10 weight % of the polymer. Examples of suitable surfactants and their use in forming toner may be found in U.S. Pat. No. 8,192,913.

In embodiments, various known suitable colorants, such as dyes, pigments, mixtures of dyes, mixtures of pigments, mixtures of dyes and pigments, and the like, may utilized to be included in a toner. In embodiments, the colorant may be included in an amount from about 0.1 weight % to about 35 weight %, or from about 1 weight % to about 15 weight %, or from about 3 weight % to about 10 weight % of the toner. Examples of suitable colorants and their use in forming toner may be found in U.S. Pat. No. 8,192,913.

One or more waxes may optionally be combined with the polyester latex particles in forming toner particles. The wax may be provided in a wax dispersion, which may include a single type of wax or a mixture of two or more different waxes. A single wax may be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition. When included, the wax may be present in an amount from about 1 weight % to about 25 weight %, or from about 2 weight % to about 20 weight %, or from about 5 weight % to about 10 weight % of the toner particles. Examples of suitable waxes and their use in forming toner may be found in U.S. Pat. No. 8,192,913.

In embodiments, the toner particles may also contain other optional additives. For example, the toner particles may include positive or negative charge control agents such as quaternary ammonium compounds including alkyl pyridinium halides, bisulfates, and alkyl pyridinium compounds; organic sulfate and sulfonate compounds; cetyl pyridinium tetrafluoroborates; distearyl dimethyl ammonium methyl sulfate; and aluminum salts. The toner particles may also be blended with external additive particles after formation including surface flow aid additives such as metal oxides titanium oxide, silicon oxide, aluminum oxides, cerium oxides, and tin oxide; and colloidal and amorphous silicas; metal salts and metal salts of fatty acids including zinc stearate, calcium stearate, or long chain alcohols.

In general, additives such as silica, titanium dioxide, zinc stearate, calcium stearate, and magnesium stearate may be applied to the surface of a toner particle for toner flow, relative humidity (RH) stability, lubricating properties, developer conductivity, tribo enhancement, admix control, improved development and transfer stability, and higher toner blocking temperatures. The external surface additives may be used with or without a polymeric coating. Examples of other suitable additives for forming a toner particle may be found in U.S. Pat. No. 8,192,913.

The latex particles prepared may be used to form toner particles by any method known in the art, including emulsion aggregation processes disclosed in U.S. Pat. No. 8,192,913; and chemical processes, such as suspension and encapsulation processes disclosed in U.S. Pat. Nos. 5,290,654; and 5,302,486, the disclosures of each of which are hereby incorporated by reference in their entirety.

Examples of suitable processes for forming toner particles from latex particles may be found in U.S. Pat. No. 8,192,913.

In embodiments, after aggregation, but prior to coalescence, a polymer coating may be applied to the aggregated latex particles to form a shell there over. Any polymer may be utilized as the shell. In embodiments, the particle may include an amorphous and/or a crystalline polyester polymer as described herein. In embodiments, an amorphous polyester polymer as described herein may be included in the shell. In other embodiments, an amorphous polyester polymer described herein may be combined with a different polymer, and then added to the particles as a polymer coating to form a shell. Examples of suitable polymers and their use in forming a shell for a toner particle may be found in U.S. Pat. No. 8,192,913.

Following aggregation to the desired particle size and application of any optional shell, the particles may then be coalesced to the desired final shape. In embodiments, coalescence may be achieved by heating a mixture of particles to a temperature from about 40° C. to about 100° C., or from about 50° C. to about 90° C., or from about 60° C. to about 80° C., which may be at or above the glass transition temperature of the polymer used to form the toner particles. In embodiments, coalescence may be achieved by heating and reducing the stirring rate from about 1000 rpm to about 100 rpm, or from about 800 rpm to about 200 rpm, or from about 1000 rpm to about 100 rpm, or from about 800 rpm to about 200 rpm, or from about 600 rpm to about 300 rpm. Coalescence may be accomplished by heating and/or stirring over a period of time from about 0.01 to about 10 hours, or from about 0.1 to about 5 hours, or from about 1 to about 2 hours. After aggregation and/or coalescence, the mixture of particles may be cooled to room temperature, e.g. from about 20° C. to about 24° C., or from about 20° C. to about 23° C., or from about 20° C. to about 22° C. After cooling, the toner particles may be optionally washed with water, and then dried, for example, by freeze-drying. Examples of suitable coalescence methods for forming a toner particle may be found in U.S. Pat. No. 8,192,913.

EXAMPLES

The following examples illustrate exemplary embodiments of the present disclosure. These Examples are intended to be illustrative only to show one of several methods of preparing the toner compositions herein and are not intended to limit the scope of the present disclosure. Also, parts and percentages are by weight unless otherwise indicated.

Example 1

Emulsification of an Amorphous Polyester Polymer Using Two Solvents 6 parts of methyl ethyl ketone, 1.8 parts of isopropyl alcohol, and 6.25 parts of water were added together to dissolve 10.0 parts of a high molecular weight propoxylated bisphenol A derived polyester polymer (Acid Value 12.3). 0.11 parts of aqueous ammonia was then added to disperse the polymer into the solvents. After dispersion of the polymer, 0.22 parts of aqueous ammonia was added to further neutralize the dispersion. To convert the dispersion into a latex, 13.74 parts of de-ionized water at about 40° C. was slowly added to the dispersion at a constant rate. The particle size after phase inversion was measured by Nanotrac instrument.

Table 1 lists the components in the formation of the latex.

TABLE 1

| Components | Parts (weight ratio based on polymer weight) | Percentage (%) |
|---|---|---|
| High MW Propoxylated Bisphenol A Derived Polyester Polymer | 10.0 | 26.2 |
| Methyl Ethyl Ketone | 6.0 | 15.7 |
| Isopropyl Alcohol | 1.8 | 4.7 |
| Aqueous Ammonia (I) (10% aqueous $NH_3$ or 10% $NH_4OH$) | 0.11 | 0.3 |
| De-ionized Water (I) | 6.25 | 16.4 |
| Aqueous Ammonia (II) (10% aqueous $NH_3$ or 10% $NH_4OH$) | 0.22 | 0.6 |
| De-ionized Water (II) | 13.74 | 36.0 |
| Total: | 38.12 | 100 |

In Example 1, the ratio of aqueous ammonia (I) to aqueous ammonia (II) was kept at a constant ratio of about 0.5. The neutralization ratio, based on the acid value of the polymer and the total amount of aqueous ammonia added, ranged from about 80% to about 110%. The resulting latex particle sizes for the different neutralization ratios are summarized in Table 2.

TABLE 2

| Neutralization Ratio (%) | D50 (nm) | D95 (nm) | Width (nm) |
|---|---|---|---|
| 80 | 212.4 | 327 | 110 |
| 90 | 198.3 | 309 | 100 |
| 100 | 198.2 | 315 | 110 |
| 110 | 200.2 | 308 | 100 |

Figure 2:
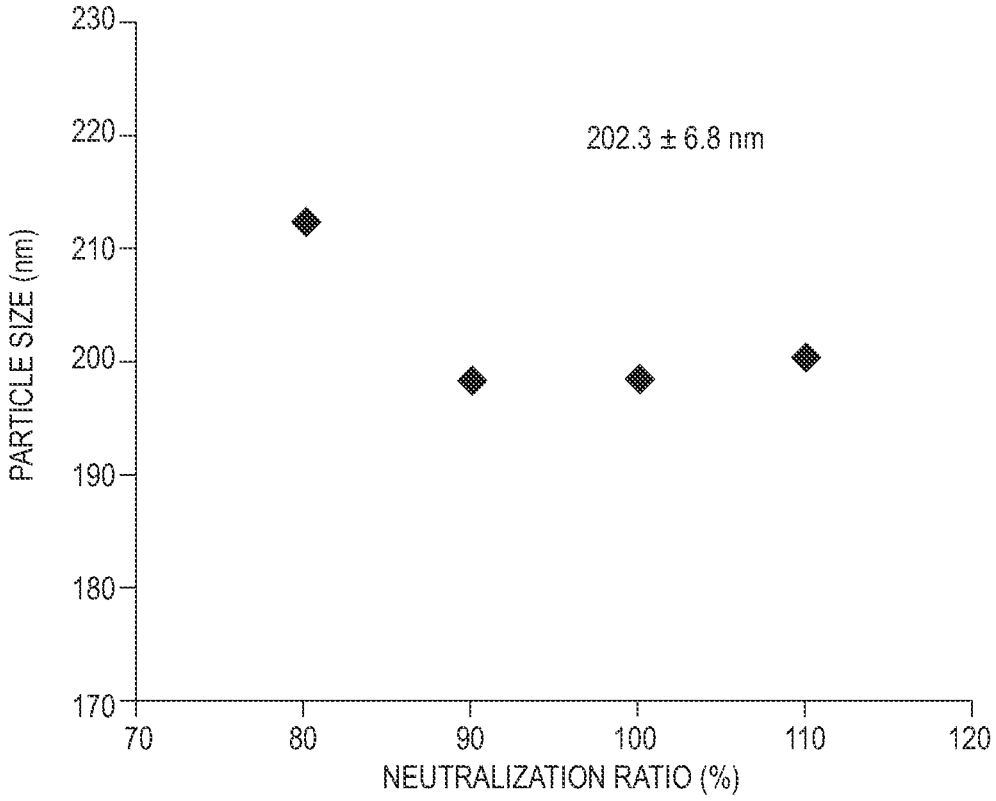
FIG. 2 illustrates a latex particle size distribution as a function of neutralization ratio for a latex made with two solvents according to an embodiment herein.

FIG. 2 illustrates the particle size distribution (nm) as a function of neutralization ratio (%) for the latex made with two solvents as prepared in Example 1. Based on the information in Table 2 and in FIG. 2, it was observed that the mean particle size distribution (D50 is about 200 nm) was relatively stable when the neutralization ratio was between about 80% and about 110%.

Figure 3:
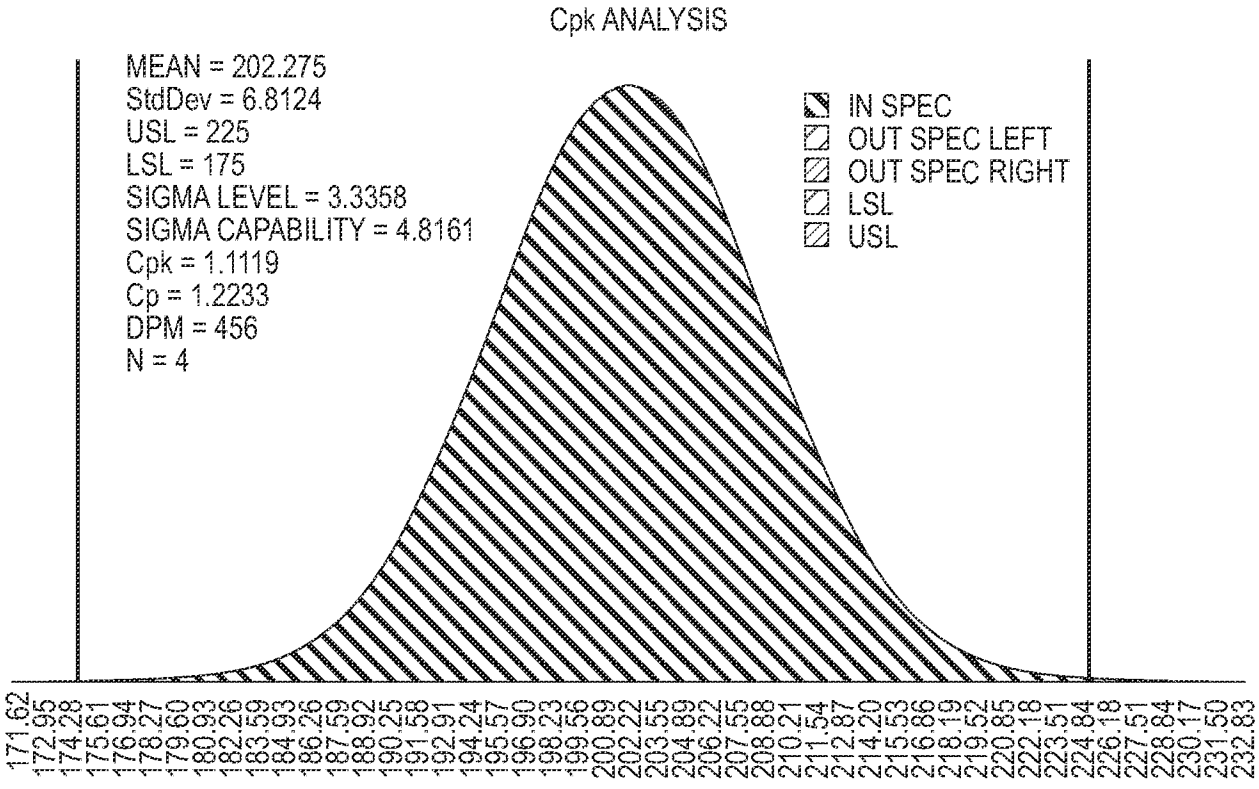
FIG. 3 illustrates a latex particle size distribution for a latex made with two solvents and a given neutralization ratio according to an embodiment herein.

As shown in FIG. 3, the PIE process described in Example 1 provided a latex with a mean particle size distribution of about 200 nm, and a particle size distribution within the lower specification limit (175 nm) and the upper specification limit (225 nm), resulting in a larger Cpk of about 1, compared to the particle size distribution shown in FIG. 1 having a particle size distribution with a Cpk of about 0.6, for a latex prepared using a fixed amount of reagents.

Example 2

Emulsification of an Amorphous Polyester Polymer Using One Solvent 13.0 parts of methyl ethyl ketone and 5.0 parts of water were added together to dissolve 10.0 parts of a high molecular weight propoxylated bisphenol A derived polyester polymer (Acid Value 12.3). 0.13 parts of aqueous ammonia was then added to disperse the polymer into the solvents. After dispersion of the polymer, 0.23 parts of aqueous ammonia was added to further neutralize the dispersion. To convert the dispersion into a latex, 20.0 parts of de-ionized water at about 40° C. was slowly added to the dispersion at a constant rate. The particle size after phase inversion was measured by Nanotrac instrument.

Table 3 lists the formulation of the latex.

TABLE 3

| Components | Parts | Percentage (%) |
|---|---|---|
| High MW Propoxylated Bisphenol A Derived Polyester Polymer | 10.0 | 20.7 |
| Methyl Ethyl Ketone | 13.0 | 26.9 |
| Aqueous Ammonia (I) (10% aqueous $NH_3$ or 10% $NH_4OH$) | 0.13 | 0.3 |
| De-ionized Water (I) | 5.0 | 10.3 |
| Aqueous Ammonia (II) (10% aqueous $NH_3$ or 10% $NH_4OH$) | 0.23 | 0.5 |
| De-ionized Water (II) | 20.0 | 41.4 |
| Total | 38.12 | 100 |

In Example 2, the ratio of ammonia (I) to ammonia (II) was kept at a constant ratio of about 0.57. The neutralization ratio, based on the acid value of the polymer and the total amount of ammonia added, ranged from about 95% to about 120%. The resulting latex particle sizes for the different neutralization ratios are summarized in Table 4.

TABLE 4

| Neutralization Ratio (%) | D50 (nm) | D95 (nm) | Width (nm) |
|---|---|---|---|
| 95 | 188.6 | 308 | 110 |
| 105 | 195.2 | 314 | 110 |
| 110 | 187.2 | 285 | 100 |
| 115 | 183.5 | 285 | 90 |
| 125 | 186.1 | 293 | 100 |

Figure 4:
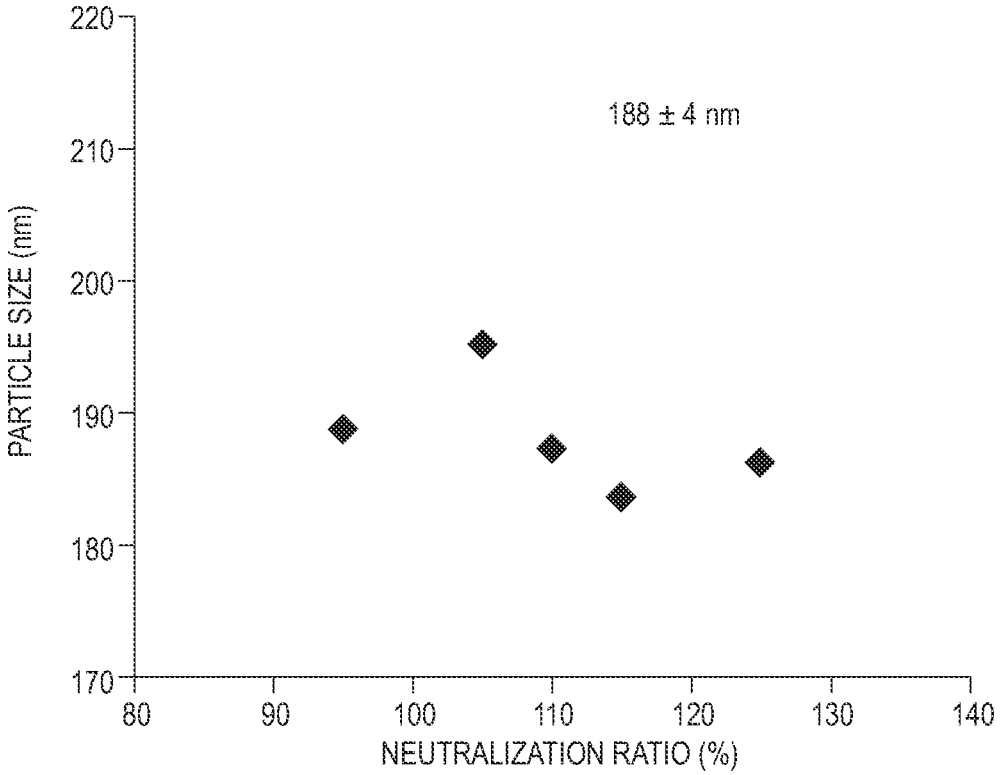
FIG. 4 illustrates a latex particle size distribution as a function of neutralization ratio for a latex made with a single solvent according to an embodiment herein.

FIG. 4 illustrates the particle size distribution (nm) as a function of neutralization ratio (%) for the latex made with one solvent as prepared in Example 2. Based on the information in Table 3 and in FIG. 4, it was observed that the mean particle size distribution (D50 is about 190 nm) was relatively stable when the neutralization ratio was between about 95% and about 125%.

Figure 5:
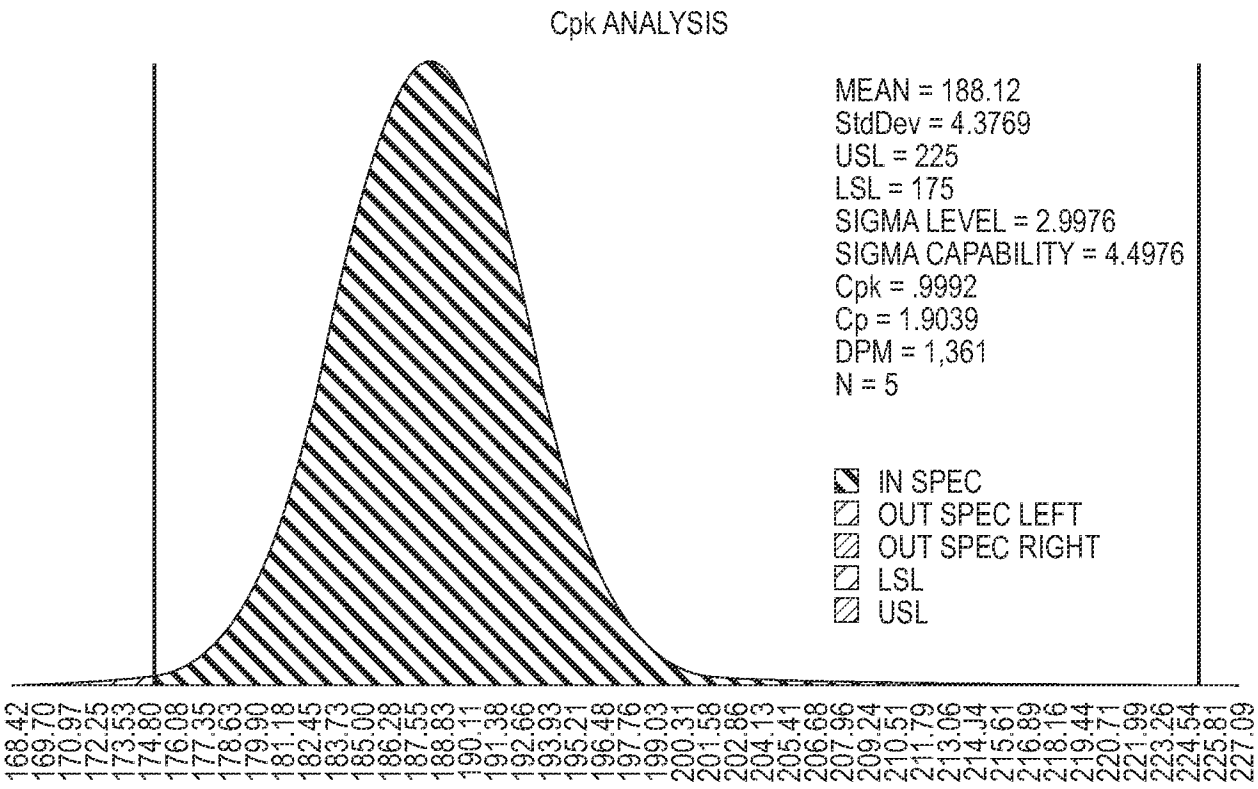
FIG. 5 illustrates a particle size distribution for a latex made with a single solvent and a given neutralization ratio according to an embodiment herein.

As shown in FIG. 5, the PIE process described in Example 2 provided a latex with a mean particle size distribution of about 187 nm, and a particle size distribution within the lower specification limit (175 nm) and the upper specification limit (225 nm), resulting in a larger Cpk of about 1, compared to the particle size distribution shown in FIG. 1 having a particle size distribution with a Cpk of about 0.6, for a latex prepared using a fixed amount of reagents.

Based on Examples 1 and 2, latex particle size distribution was stable and independent of the neutralization ratio for both the two solvent and single solvent formulations and processes when the neutralization ratios was within specific ranges, e.g. from about 80% to about 110% for two solvents; and from about 95% to about 125% for a single solvent. In other words, neutralization ratios within these ranges may generate latex particles with the desired particle size distribution.

Based on the results of Examples 1 and 2, if a particular neutralization ratio is chosen, the acceptable acid values for a polyester polymer may be calculated according to Equation 2 above to provide the desired particle size distribution.

In Example 1, the two-solvent formulation uses: 0.354 parts ammonia (vs. 10 parts polymer), which corresponds to 95% neutralization ratio for the polymer used. According to Equation 2, the calculated acid values for the polymer are about 10.6 and 14.6 when the neutralization ratios are about 110% and 80%, respectively. That being said, a polymer with an acid value between about 10.6 and 14.6 will have a neutralization ratio ranging from about 80% to about 110% when using 0.354 parts of ammonia, leading to generation of latex particles having a mean particle size distribution (D50) of about 200 nm with a Cpk of about 1 or greater.

In Example 2, the one solvent formulation uses: 0.410 parts ammonia (vs. 10 parts polymer), which corresponds to 110% neutralization ratio for the polymer used. Based on Equation 2, the calculated acid values for the polymer are about 10.8 and 14.2 when the neutralization ratios are about 125% and 95%, respectively. That being said, a polymer with acid value between about 10.8 and 14.2 will have the neutralization ratio ranging from about 95% to about 125%, leading to generation of latex particles having a mean particle size distribution (D50) of about 190 nm with a Cpk of about 1 or greater.

It will be appreciated that variations of the above-disclosed and other features and functions, or alternatives thereof, may be desirably combined into many other different systems or applications. Also that various, presently unforeseen or unanticipated, alternatives, modifications, variations or improvements therein may be subsequently made by those skilled in the art which are also intended to be encompassed by the following claims.

What is claimed is:

1. A phase inversion emulsification process for preparing latex particles comprising:

contacting a polymer with a solvent and a neutralizing agent comprising adding the neutralizing agent in two separate steps, wherein the particles have a lower specification limit of from about 150 nm to about 200 nm, and wherein the particles have an upper specification limit of from about 200 nm to about 250 nm.

2. The process of claim 1, wherein the process has a Cpk of from about 0.8 to about 1.3.

3. The process of claim 1, wherein adding the neutralizing agent in two separate steps comprises adding the neutralizing agent in different amounts for each of the two separate steps.

4. The process of claim 1, wherein adding the neutralizing agent in two separate steps comprises adding the same neutralizing agent in each of the two separate steps.

5. The process of claim 1, wherein the adding the neutralizing agent in two separate steps comprises adding a different neutralizing agent in each of the two separate steps.

6. The process of claim 1, wherein the neutralizing agent is present at a neutralization ratio of from about 50% to about 150%.

7. The process of claim 1, further comprising contacting the polymer with water.

8. A phase inversion emulsification process for preparing latex particles comprising:

contacting a polymer with a solvent and a neutralizing agent wherein the neutralizing agent is added in a two step process comprising a first step of adding a first amount of the neutralizing agent and a second step of adding a second amount of the neutralizing agent, wherein the same neutralizing agent is added in the first step and in the second step wherein the neutralizing agent is present at a neutralization ratio of from about 50% to about 150%.

9. The process of claim 8, wherein the process has a Cpk of from about 0.8 to about 1.3.

10. The process of claim 8, wherein the solvent is present at a solvent ratio of from about 10% to about 100%.

11. The process of claim 8, wherein the solvent is present from about 20 weight % to about 100 weight % of the polymer.

12. The process of claim 8, wherein the polymer has an acid value of from about 10.0 to about 15.0.

13. The process of claim 8, wherein the amount of neutralizing agent added in the first step is less than the amount of neutralizing agent added in the second step.

* * * * *